US008246218B2

(12) United States Patent
Gu et al.

(10) Patent No.: US 8,246,218 B2
(45) Date of Patent: Aug. 21, 2012

(54) LIGHT-EMITTING DIODE LAMP

(75) Inventors: Huai-Shan Gu, Shenzhen (CN); Li-Tao Zhang, Shenzhen (CN); Wen-Hsiang Lu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 139 days.

(21) Appl. No.: 12/796,646

(22) Filed: Jun. 8, 2010

(65) Prior Publication Data

US 2011/0141745 A1 Jun. 16, 2011

(30) Foreign Application Priority Data

Dec. 11, 2009 (CN) ..... 2009 1 0311329

(51) Int. Cl.
*F21V 3/00* (2006.01)

(52) U.S. Cl. ..... 362/311.02; 362/249.02; 362/362; 362/364; 362/368

(58) Field of Classification Search ..... 362/311.02, 362/646, 249.02, 362, 364, 365, 366, 368
See application file for complete search history.

(56) References Cited

U.S. PATENT DOCUMENTS

| | | | | |
|---|---|---|---|---|
| 6,561,690 | B2 * | 5/2003 | Balestriero et al. | 362/555 |
| 6,733,164 | B1 * | 5/2004 | Smith, Jr. | 362/545 |
| 7,654,703 | B2 * | 2/2010 | Kan et al. | 362/362 |
| 7,887,218 | B2 * | 2/2011 | Wang | 362/240 |
| 8,021,024 | B2 * | 9/2011 | Huang | 362/294 |
| 8,083,381 | B2 * | 12/2011 | Tsai | 362/311.02 |
| 2008/0130299 | A1 * | 6/2008 | Dorogi | 362/373 |
| 2010/0277917 | A1 * | 11/2010 | Shan | 362/249.02 |

* cited by examiner

*Primary Examiner* — John A Ward
(74) *Attorney, Agent, or Firm* — Altis Law Group, Inc.

(57) ABSTRACT

A light-emitting diode lamp includes a top shell, a bottom shell fixed to the top shell, a printed circuit board carrying light-emitting diodes, a lens, and a latch fixed on the bottom shell movably. The bottom shell defines two grooves. One end of the grooves is open and adjacent to the open end of the other groove. The printed circuit board is between the top shell and the bottom shell. The lens is slidingly retained by the grooves. The latch is located at the open ends of the grooves and preventing the lens from disengaging from the grooves.

14 Claims, 4 Drawing Sheets

LIGHT-EMITTING DIODE LAMP

BACKGROUND

1. Technical Field

The present disclosure relates to light-emitting diode (LED) lamps, especially to an LED lamp with replaceable lens.

2. Description of Related Art

Light-emitting diode (LED) lamps often include a lens protecting the light-emitting diode. The LED lamps often include a top shell connected to a bottom shell, with the lens is fixed therebetween. If the lens is damaged, the top shell and the bottom shell must be disassembled before replacing the lens, which is inconvenient and time-consuming.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
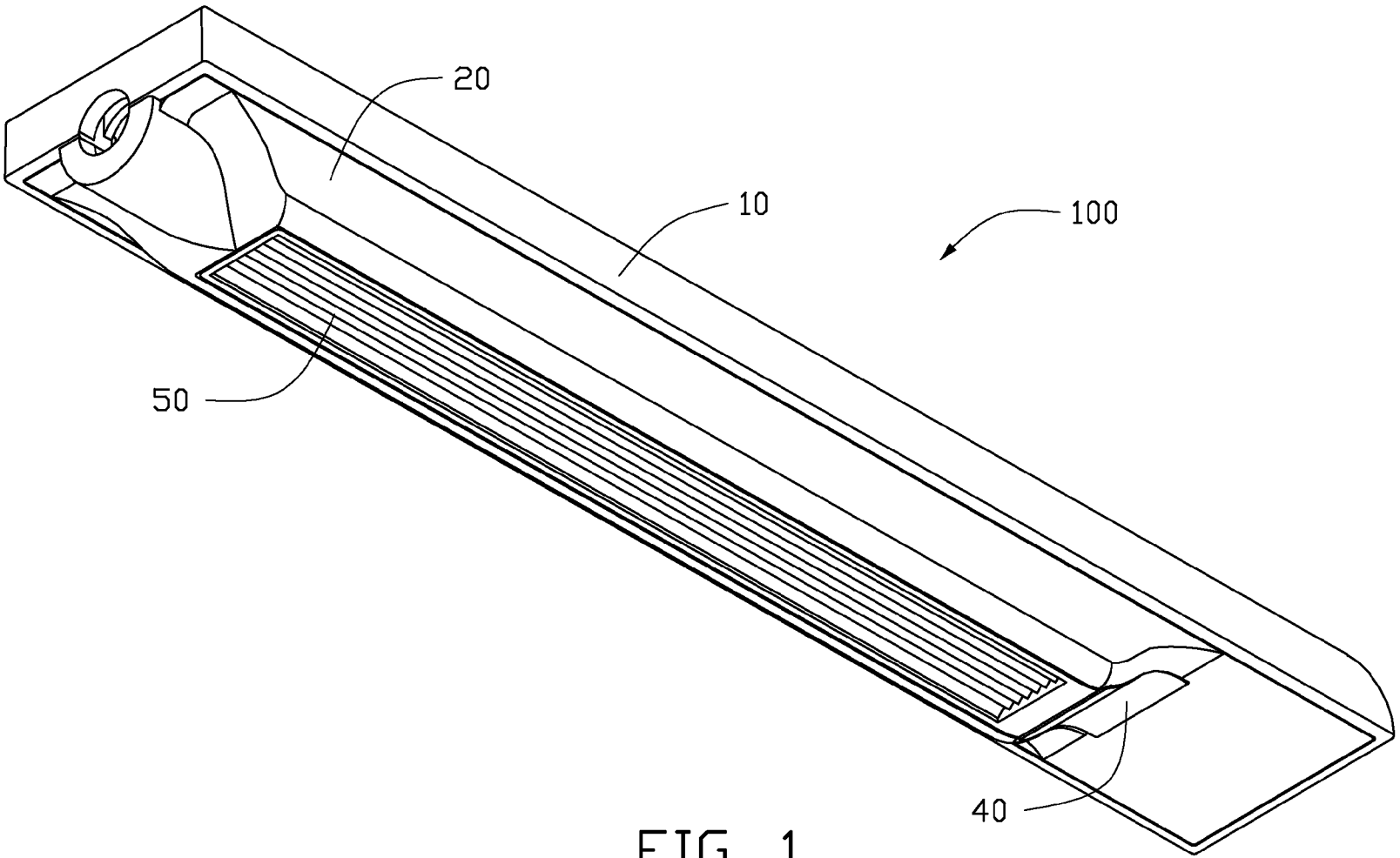
FIG. 1 is a schematic view of an LED lamp according to an exemplary embodiment.

Referring to FIG. 1, a light-emitting diode (LED) lamp 100 according to an exemplary embodiment includes a top shell 10, a bottom shell 20, a latch 40 and a lens 50. The bottom shell 20 is fixed to the top shell 10. The lens 50 is seated in the bottom shell 20 and slidably removable therefrom, enabling simple replacement. The latch 40 is movably fixed to the bottom shell 20. When the lens 50 is installed in the bottom shell 20, the latch 40 blocks the lens 50 from sliding out of the bottom shell 20. When the lens 50 is to be replaced, latch 40 is moved upward to release the lens 50 which can then be removed, thus enabling replacement of the lens 50.

Figure 2:
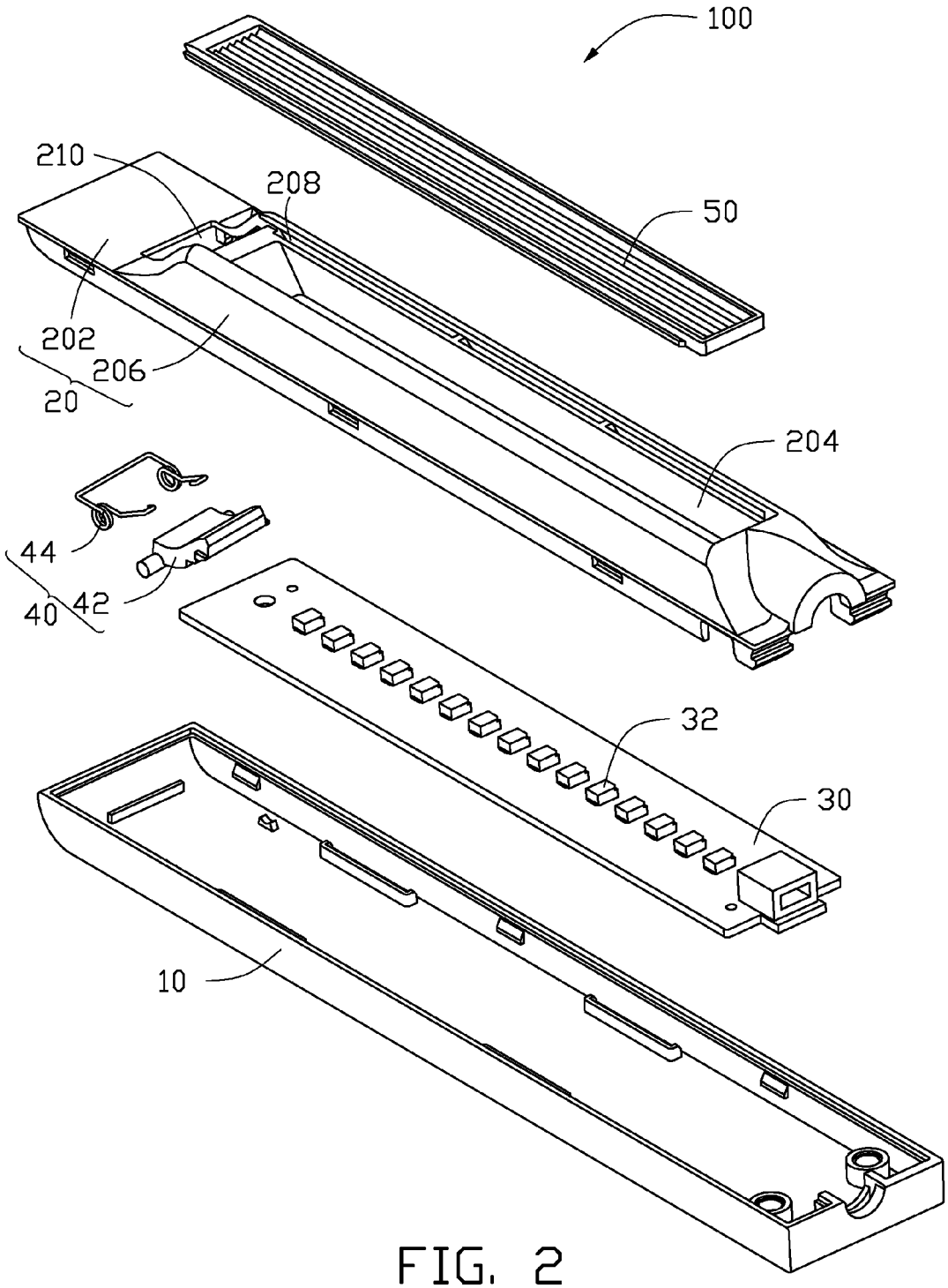
FIG. 2 is an exploded view of the LED lamp of FIG. 1.

Referring to FIG. 2, the LED lamp 100 further includes a printed circuit board 30 with multiple light-emitting diodes 32 between the top shell 10 and the bottom shell 20.

Figure 3:
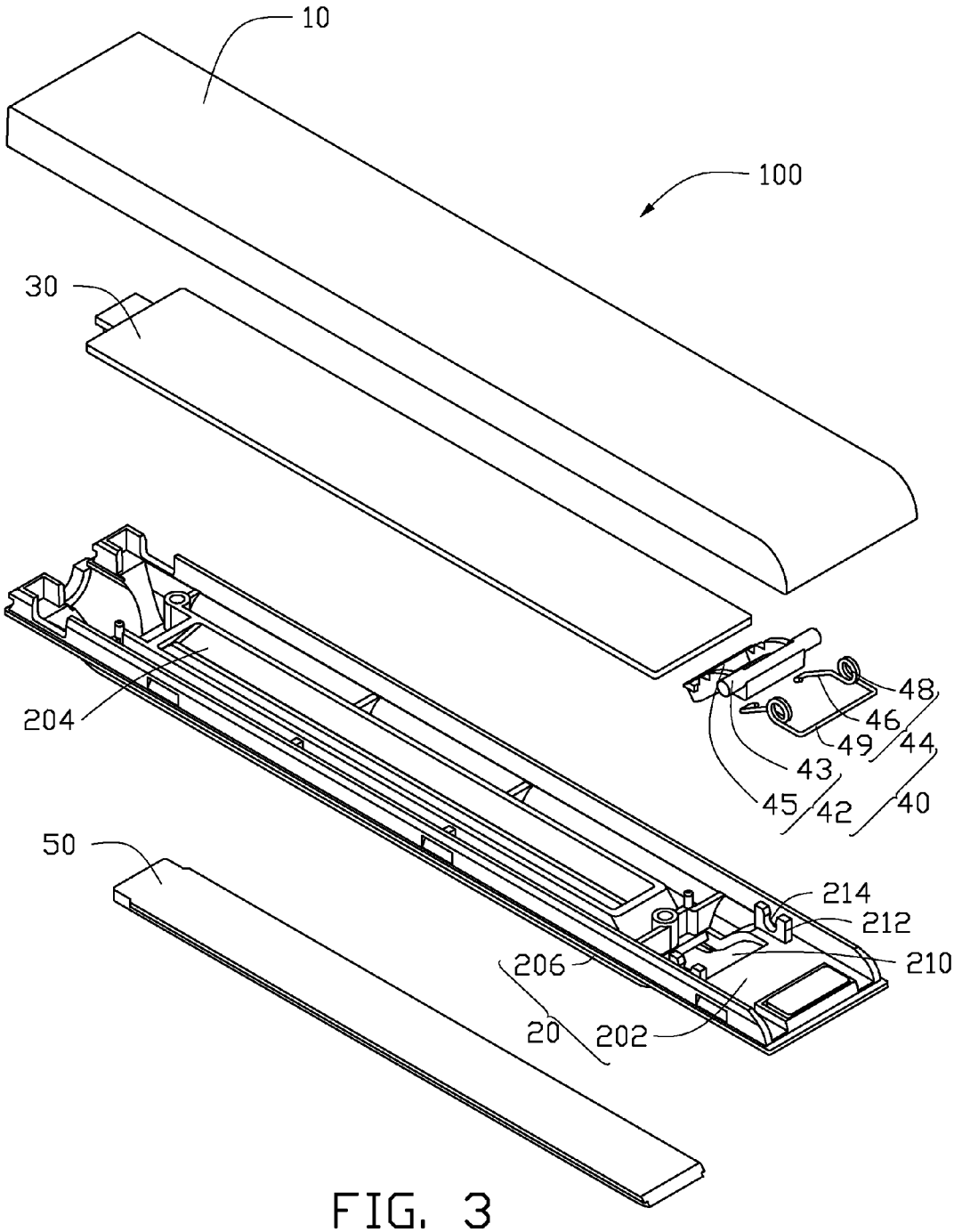
FIG. 3 is similar to FIG. 2, but viewed from below.

Referring to FIGS. 2 and 3, the bottom shell 20 includes a rectangular base 202, two opposite sidewalls 206 extending from the edges of the base 202 and two blocks 212 extending from the base 202 on the opposite side to the sidewall 206. Two grooves 208 are defined in two opposite inner surfaces of the two sidewalls 206. One end of each groove 208 is open and the other closed, so as to allow entry of the lens 50 thereinto, and seating of lens 50 therein. The base 202 defines an elongated through-hole 204 between the two sidewalls 20 and an oblique notch 210 adjacent to the open end of the groove 208. The light-emitting diodes 32 face the through-hole 204, such that light therefrom is emitted from the bottom shell 20 after passing therethrough. The notch 210 accommodates the latch 40. The two blocks 212 face the top shell 10 on two opposite sides of the notch 210. Each block 212 defines an indentation 214.

Figure 4:
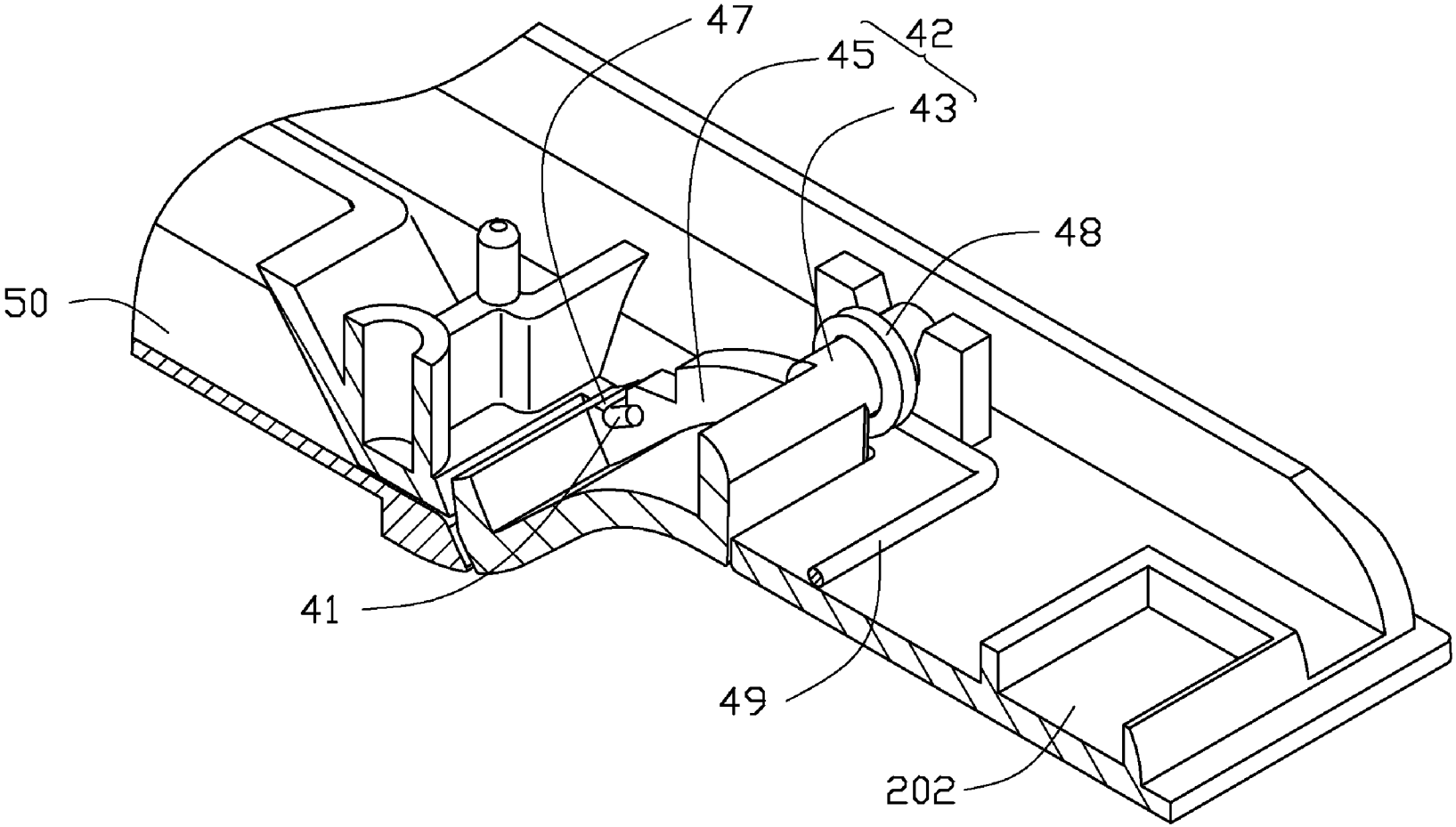
FIG. 4 is a partial, cutaway view of the LED lamp of FIG. 1 with a top shell removed.

Referring to FIGS. 3 and 4, the latch 40 includes a tongue 42 and a spring 44 fixed on the tongue 42. The tongue 42 includes a shaft 43 and a rotation portion 45 extending along the radial direction of the shaft 43. The shaft 43 is rotatably received in the indentation 214. The rotation portion 45 is oblique and matches notch 210. The rotation portion 45 is received in the notch 210 to seal it. One end of the rotation portion 45 seals the groove 208 and blocks the lens 50 from sliding out the groove 208. The other end of the rotation portion 45 is blocked by the edge of the notch 210, fixing the latch 40 therein.

The spring 44 includes two helical portions 48 connected by a connection portion 49, and two end portions 46 respectively extending from the two helical portions 48. The helical portion 48 fits over the shaft 43, the connection portion 49 is positioned on the base 202, and the end portion 46 biases the rotation portion 45 supplying elastic force, impelling the rotation portion 45 to close the groove 208. The end portion 46 bends to form a hook 41. The rotation portion 45 defines a clasping groove 47. The hook 41 is received in the clasping groove 47, such that the end portion 46 presses the rotation portion 45 firmly.

Referring also to FIGS. 2 and 4, during replacement of the lens 50, pressure on the rotation portion 45 removes it from the groove 208, the lens 50 is removed from the groove 208 and a new lens installed, after which release of rotation portion 45 returns it to the groove 208 under the elastic force of the spring 44. In this way, the lens of the light-emitting diode lamp 100 is replaced conveniently.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A light-emitting diode lamp comprising:

a top shell;

a bottom shell fixed to the top shell, defining two grooves, wherein one end of each groove is open and adjacent to the open end of the other groove;

a printed circuit board with light-emitting diodes mounted thereon, located between the top shell and the bottom shell;

a lens slidably retained by the grooves; and a latch movably fixed on the bottom shell, wherein the latch is located at the open ends of the grooves and preventing the lens from disengaging from the grooves.

2. The light-emitting diode lamp of claim 1, wherein the bottom shell protrudes two opposite sidewalls thereon, in two opposite inner surfaces of which the grooves are defined.

3. The light-emitting diode lamp of claim 1, wherein the bottom shell comprises a rectangular base, the base defines a notch adjacent to the open ends of the groove, the latch received in the notch.

4. The light-emitting diode lamp of claim 3, wherein the latch comprises a tongue, the tongue comprises a shaft and a rotation portion extending along the radial direction of the shaft, the shaft is rotatably fixed on the bottom shell, and wherein one end of the rotation portion blocks the lens and the other end of the rotation portion is blocked by the edge of the notch.

5. The light-emitting diode lamp of claim 4, wherein the latch further comprises a elastic member fixed on the tongue, the elastic member configured for supplying elastic force to the rotation portion to keep the latch blocking the lens.

6. The light-emitting diode lamp of claim 4, wherein two blocks protrude from the base, the two blocks face the top shell and are respectively located at two opposite sides of the notch, the block defines an indentation, the shaft is rotatably received in the indentation.

7. The light-emitting diode lamp of claim 5, wherein the elastic member comprises two helical portions, a connection portion connecting the two helical portions, and two end portions respectively extending from the two helical portions, wherein each helical portion fits over the shaft, and the connection portion is positioned on the base such that the end portion presses on the rotation portion.

8. The light-emitting diode lamp of claim 7, wherein the rotation portion defines a clasping groove receiving a hook formed by the end portion bending.

9. A light-emitting diode lamp comprising:

a shell connecting to a printed circuit board on which light-emitting diodes are mounted; the shell further defining two grooves in two opposite inner surfaces of the shell respectively; an open end communicating with one end of the grooves;

a lens slidably retained by the grooves from the open end of the shell; and a latch movably fixed on the shell, wherein the latch is positioned at the open end of the shell and preventing the lens from disengaging from the grooves.

10. The light-emitting diode lamp of claim 9, wherein the shell comprises a rectangular base, the base defines a notch adjacent to the open end of the shell, the latch is received in the notch.

11. The light-emitting diode lamp of claim 10, wherein the latch comprises a tongue, the tongue comprises a shaft and a rotation portion extending along the radial direction of the shaft, the shaft is rotatably fixed on the shell, one end of the rotation portion blocks the lens, the other end of the rotation portion is blocked by the edge of the notch.

12. The light-emitting diode lamp of claim 11, wherein the latch further comprises a elastic member fixed on the tongue, the elastic member is configured for supplying elastic force to keep the rotation portion blocking the lens.

13. The light-emitting diode lamp of claim 12, wherein the elastic member comprises two helical portions, a connection portion connecting the two helical portions, and two end portions respectively extended from the two helical portions, the helical portion is fitted over the shaft, the connection portion is positioned on the base, the end portion presses on the rotation portion.

14. The light-emitting diode lamp of claim 13, wherein the rotation portion defines a clasping groove, the end portion bends to form a hook clasping in the clasping grooves.

* * * * *